US006701861B2

(12) United States Patent
Key et al.

(10) Patent No.: US 6,701,861 B2
(45) Date of Patent: Mar. 9, 2004

(54) SEMI-SUBMERSIBLE FLOATING PRODUCTION FACILITY

(75) Inventors: Joe Wayne Key, Magnolia, TX (US); Paul Ray Geiger, Sr., Houston, TX (US); Calvin Vinal Norton, Houston, TX (US); Robert Edward Clague, Houston, TX (US)

(73) Assignee: Friede & Goldman, Ltd., Houston, TX (US)

( * ) Notice: Subject to any disclaimer, the term of this patent is extended or adjusted under 35 U.S.C. 154(b) by 0 days.

(21) Appl. No.: 10/138,671

(22) Filed: May 3, 2002

(65) Prior Publication Data

US 2003/0205189 A1 Nov. 6, 2003

(51) Int. Cl.[7] ..... B63B 35/00
(52) U.S. Cl. ..... 114/265
(58) Field of Search ..... 114/264, 265

(56) References Cited

U.S. PATENT DOCUMENTS

| | | | | | |
|---|---|---|---|---|---|
| 3,163,147 | A | * | 12/1964 | Collipp | 114/265 |
| 3,575,005 | A | * | 4/1971 | Summer | 405/196 |
| 3,577,946 | A | | 5/1971 | Horton | |
| 3,653,349 | A | * | 4/1972 | Brown | 114/265 |
| 3,919,957 | A | | 11/1975 | Ray et al. | |
| 3,986,471 | A | * | 10/1976 | Haselton | 114/265 |
| 4,114,393 | A | | 9/1978 | Engle, Jr. et al. | |
| 4,437,794 | A | | 3/1984 | Grimsley et al. | |
| 4,457,250 | A | | 7/1984 | Oshima et al. | |
| 4,819,730 | A | * | 4/1989 | Williford et al. | 166/355 |
| 4,823,719 | A | * | 4/1989 | Sarwe | 114/126 |
| 5,951,061 | A | * | 9/1999 | Arlt et al. | 285/94 |
| 6,024,040 | A | | 2/2000 | Thomas | |
| 6,190,089 | B1 | | 2/2001 | Bennett, Jr. et al. | |
| 6,247,421 | B1 | * | 6/2001 | Ludwigson | 114/265 |
| 6,273,018 | B1 | | 8/2001 | Gottsche et al. | |
| 6,435,773 | B1 | * | 8/2002 | Khachaturian | 405/202 |

* cited by examiner

*Primary Examiner*—Sherman Basinger
(74) *Attorney, Agent, or Firm*—Keaty Professional Law Corporation

(57) ABSTRACT

A semi-submersible floating production vessel which has a ring pontoon. Three main columns extend upwardly from corners of the pontoon and three secondary, minor columns. extend upwardly from centers of the triangle sides. The columns are surrounded with fenders for protecting the columns from impact with floating bodies. The columns support an open frame deck, on which production modules are positioned. The vessel is adapted for semi-permanent mooring with pre-tensioned mooring lines that are attached to swivel padeyes secured on the main columns below the water line. Production and export risers are connected to the vessel below the water line. Compressed air ballast system allows selective emptying of ballast compartments located in the ring pontoon and eliminates the need for a conventional pump room.

16 Claims, 9 Drawing Sheets

SEMI-SUBMERSIBLE FLOATING PRODUCTION FACILITY

BACKGROUND OF THE INVENTION

This invention relates to semi-submersible offshore vessels, and more particularly to production facilities suitable for development of oil and gas mineral reserves in water depths of one thousand to six thousand feet, or greater depths.

Semi-submersible vessels are widely used for drilling and production operations in offshore locations for development of mineral subsea resources. These semi-submersible vessels provide relatively easy mobility and can be deployed near a prepared well site and then anchored by catenary or semi-taut mooring lines.

Semi-submersible platforms usually comprise of horizontal buoyant members (or pontoons) submerged below the water surface and supporting production or drilling platforms by columns extending from the underwater pontoon to a level above expected wave action. The pontoons are located below the expected height of wave action to reduce the wave-induced response of the platform. Semi-submersible production platforms are usually deployed after exploratory operations have been completed and the nature of mineral deposits and exact locations have been identified.

Construction and outfitting of a production platform has been and remains extremely costly, requiring several years of construction and preparation. Once completely outfitted, the production platform is usually brought to the well site, moored, and set for production operations by connecting the flow lines and the export pipe lines to the equipment on the platform.

The pontoons utilized for semi-submersible vessels may be designed as separate horizontal members or as ring pontoons. This invention relates to a semi-submersible vessel utilizing a ring pontoon, which supports vertical columns. The columns support a superstructure deck or decks. The pontoon of the instant invention has adjustable ballast capability to allow the vessel to be easily transported to the production location and, after reaching the desired location get ballasted to cause the pontoons to become submerged below the surface of the water and provide the necessary stability to the vessel.

SUMMARY OF THE INVENTION

It is an object of the present invention to provide a semi-submersible floating production facility that can be completely outfitted at the dry dock where the hull is constructed prior to the offshore installation.

It is another object of the present invention to provide a semi-submersible vessel utilizing a ring pontoon with a sufficiently large water plane inertia to ensure adequate stability while minimizing the vessel motion response. It is a further object of the present invention to provide a semi-submersible vessel with an open frame deck that allows changing of production modules from oil to gas production in an easy and inexpensive manner.

It is still a further object of the present invention to provide a semi-submersible vessel that can be moored and does not require dynamic positioning equipment.

These and other objects of the present invention are achieved through a provision of a semi-submersible floating production vessel with a ring pontoon generally shaped as an equilateral triangle. Three main columns extend from three corners of the triangle, the main columns contributing the significant portion to the water planearea of the vessel. A plurality of thin secondary supporting columns extends from the ring pontoon upwardly to support an open frame deck. The secondary columns extend from approximately geometric centers of the ring pontoon connecting members between the main columns.

The open frame deck structure facilitates modular construction and allows positioning of production modules on the deck of the vessel and changing of the modules from oil- to gas-adapted production modules in a relatively inexpensive, expeditious manner. Special liquid storage tanks, such as methanol tanks are supported below the deck. The deck also supports dual fuel electrical power generators as part of the modular assembly.

The vessel has a plurality of production and export risers that are secured to the vessel below the water line. The vessel is adapted for semi-permanent mooring with pre-tensioned mooring lines that are attached to the vessel by swivel padeyes secured below the water line. Such arrangement allows transfer of the vertical component of the load from the mooring lines to the vessel main columns. Additionally, the vessel does not require a dynamic positioning system with associated thrusters, diesel generators and control systems.

The ring pontoon is divided into a plurality of separate ballast compartments. A compressed air ballast system is utilized to selectively empty each ballast compartment for inspection and repair, if necessary. As a result, the need for a separate pump room and associated equipment is eliminated.

The vessel structure extensively uses box girders and flat plate girders for ease of construction and maintenance. This design significantly reduces the time needed for construction of the vessel, reduces the steel requirements and increases allowable deck loads. The vessel design more effectively dampens the heave motions, reduces the roll motions and stresses in the primary structural members, as well as improves the fatigue life.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
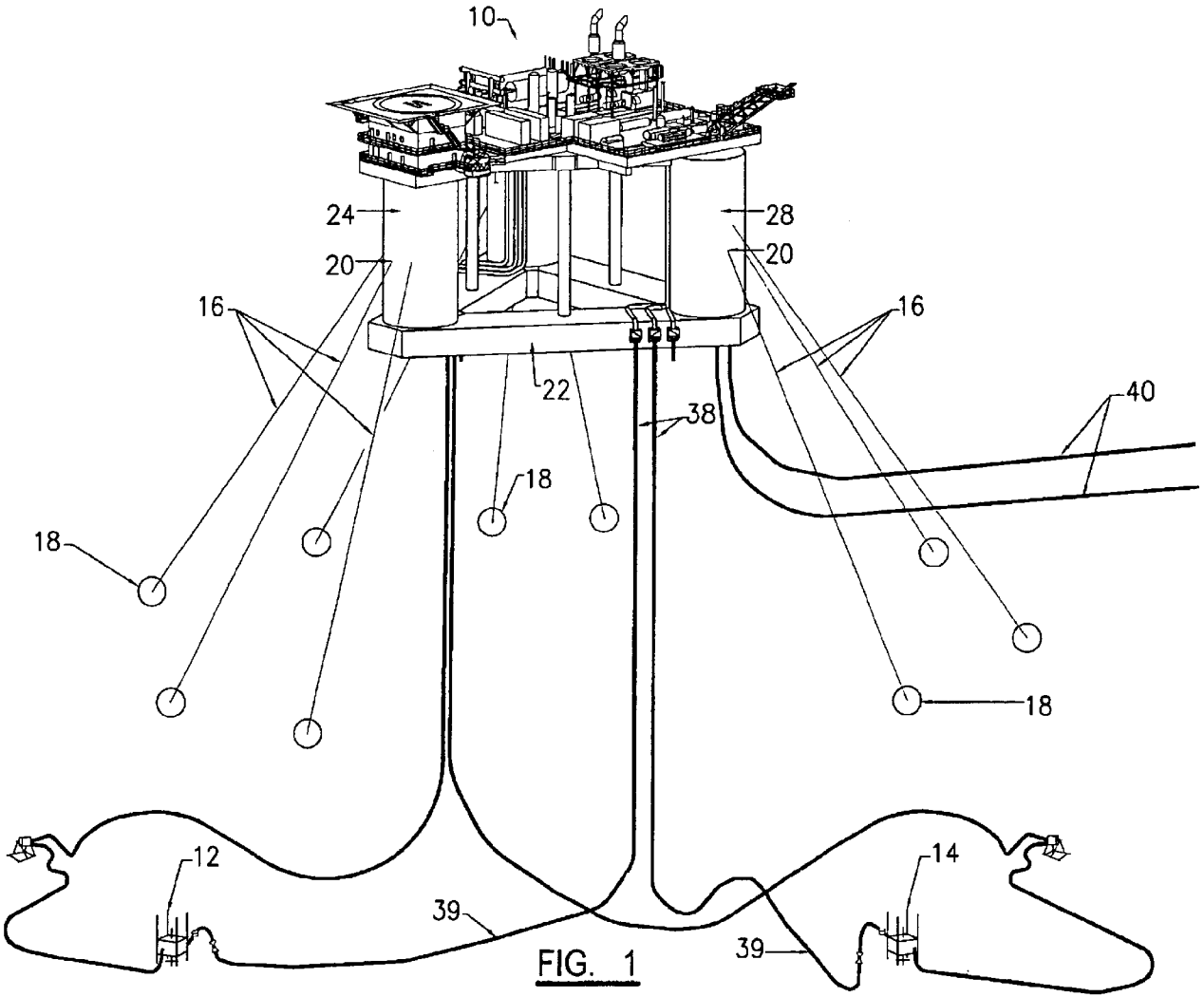
FIG. 1 is a schematic view of the semi-submersible vessel in accordance with the present invention positioned at an offshore location.

Turning now to the drawings in more detail, numeral 10 designates the semi-submersible floating production vessel in accordance with the present invention. The vessel 10 is moored at a location above sub sea production wells 12 and 14. A plurality of mooring lines 16 are pre-tensioned and secured by suction piles or special anchors designated by numeral 18, to the seabed.

The mooring lines, which can be nine in number, are secured at their upper ends to mooring swivel padeyes 20. The swivel padeyes 20 can rotate about their vertical shaft to accommodate the vessel surge, sway, and yaw that can be encountered with changes in the direction of wind, wave and currents. The upper end of each mooring line can be connected directly to the mooring swivel padeye 20 with a conventional shackle that accommodates the varying angle in a vertical plane that will result over the full range of water depth.

The vessel 10 does not require mooring winches or windlasses since the vessel is expected to be permanently positioned for long durations and there will be no need to change the mooring line tension during the operations. The elimination of the mooring winches and windlasses, which are conventionally found on offshore platforms, reduces the topside weight, frees the valuable deck space for the required production equipment and significantly reduces the capital expenditures and maintenance costs of the vessel. The mooring lines 16 are properly pre-tensioned with a simple underwater tensioner device that is conventionally used in the offshore industry for such purposes.

The swivel padeyes 20, to which the mooring lines 16 are connected, are located below the water line. As a result, the vertical component of the load acting on the mooring lines 16 is transferred to the structure itself, and more particularly to the major columns, as will be described hereinafter, to a level below the water line, near the center of the vessel's roll and pitch. Conventionally, the mooring lines are suspended from the deck. By connecting the mooring lines through the padeye assemblies 20 to the major columns below the water line the vessel's stability is significantly increased and the topside load capacity that can be handled at the deck level is significantly improved.

The vessel 10 of the present invention comprises a ring-shaped pontoon 22 that contributes significantly to the water plane area of the vessel in the transit condition. The pontoon 22 is comprised of three sections, each having a generally rectangular cross section. From the three corners of the triangular ring pontoon extend three upstanding columns designated by numbers 24, 26, and 28 in the drawings. The major, or main columns 24, 26, and 28 have a relatively large diameter, they rise above the surface of the sea waves and support an upper hull main deck 30. Three secondary, or minor columns 32, 34, and 36 extend from the center of each section of the ring pontoon and help support the main deck 30. The minor columns 32, 34, and 36 have a relatively thin profile and offer limited resistance to wind and water, while increasing stability of the vessel 10.

A series of flexible flow lines 39 extend from the wells 12 and 14 on the seabed and production risers 38 extend up to the pontoon 22. The flow lines 39 are fluidly connected to production risers 38. The flow lines 39 and the risers 38 deliver the mineral resource, being it oil or gas, through the production facilities and then to export lines 40. The export pipelines 40 (FIG. 1) extend from the vessel 10 to onshore facilities or to a tanker (not shown) or other such transportation facility that will deliver the oil or gas to a land-based processing facility. The vessel 10 is provided with spare riser porches and can handle multiple production and export risers. The riser porches can support either flexible pipe risers or steel catenary risers to allow optimum riser configuration to be selected based on the specific on-site requirements.

Figure 2:
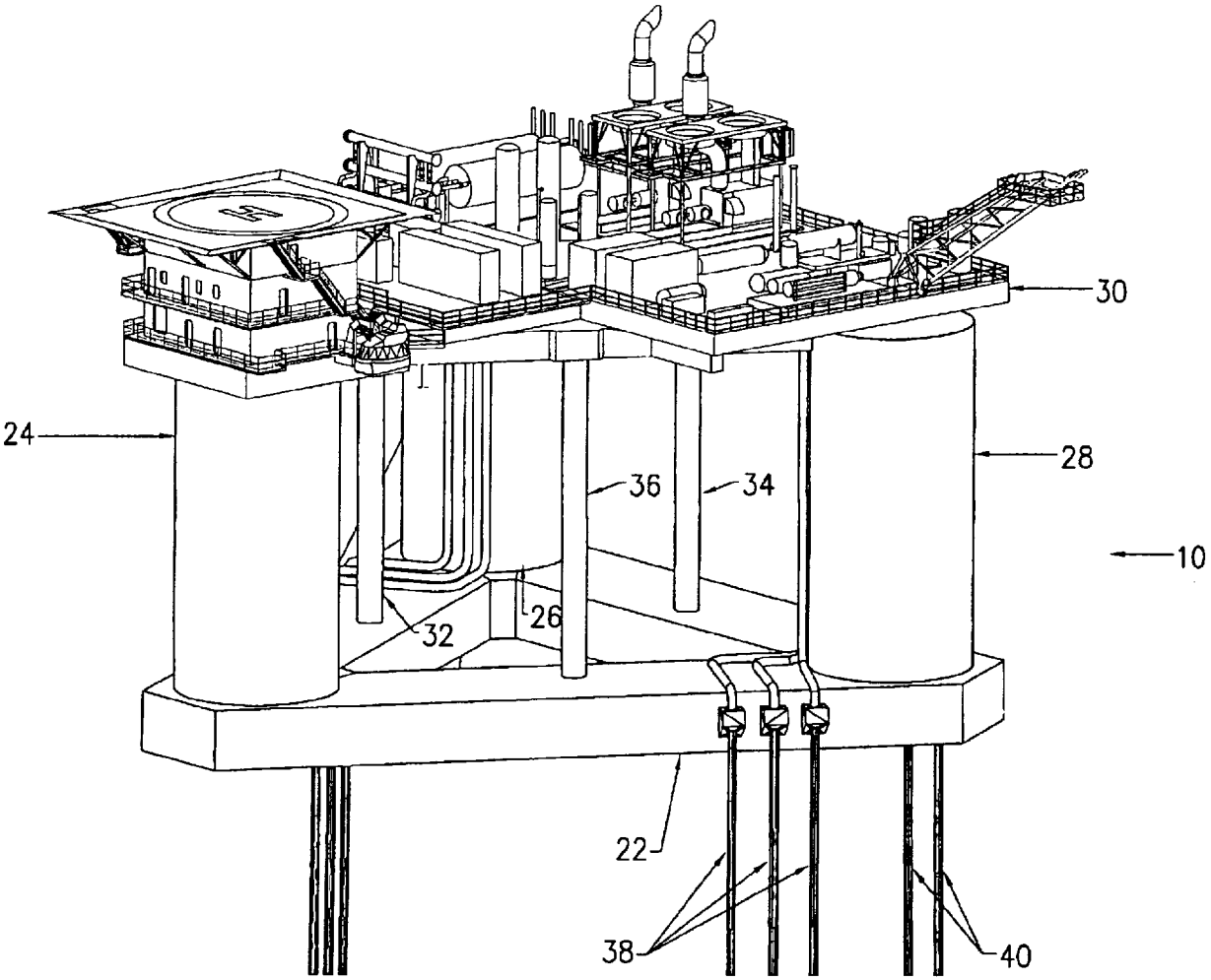
FIG. 2 is a perspective view of the semi-submersible vessel of the present invention.
Figure 5:
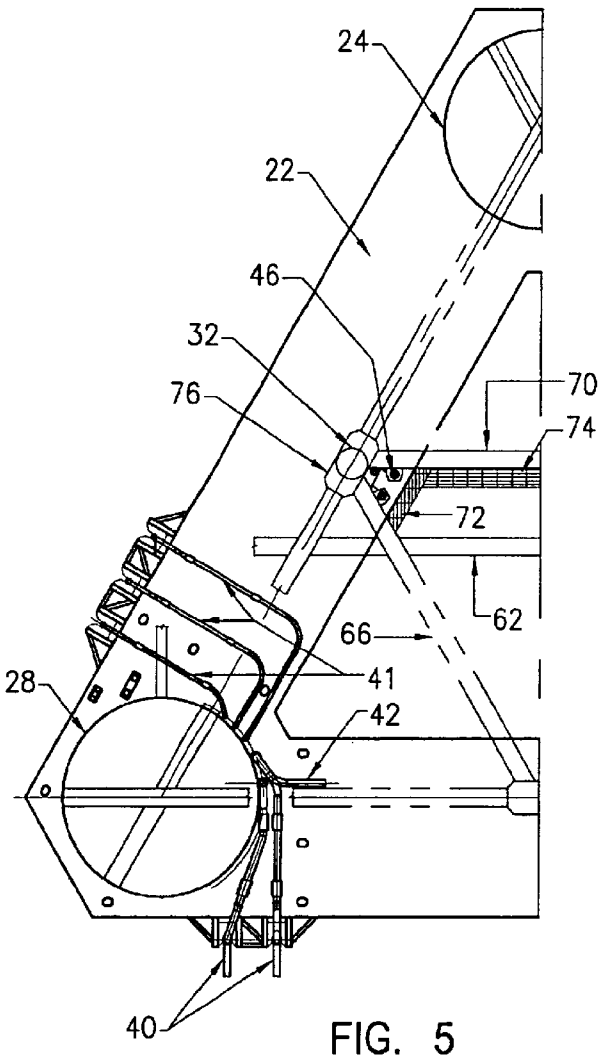
FIG. 5 is a detail view illustrating riser porches and I-tubes for the control umbilicals.

As can be seen in more detail in FIG. 5, the export riser 40 is inter-connected to a plurality of production risers 38, interconnect piping 41, which are in turn connected to the flexible flow lines 39 (FIG. 1). The mineral resources extracted from the seabed are delivered through the flow lines 39, production risers 38, through the production facilities, and then to the export risers 40 with the help of a compressor module or oil pump module mounted on the deck which is connected by piping 42. The production risers 38 extend across the top surface of the pontoon 22, as shown in FIG. 2, and then, directed along the columns 26, and 28, extend below the deck 30, where they connect to the production modules, and then to the export risers 40.

The platform 10 supports the production risers 38 and the export risers 40 below the water line (FIG. 2) near the vessel keel rather than from the deck as is done in conventional semi-submersible vessels. As a result, the significant vertical load of the risers is moved to a lower elevation, which drastically improves the vessel's stability and facilitates a significant increase in the variable load that can be handled at the level of the deck 30. This design also reduces the wave and current forces on the risers and makes the risers less susceptible to damage from supply boats or other small craft that operate in close proximity to the production unit 10. Additionally, the semi-submersible vessel 10 is not sensitive to changes in the water depth or to the number of the mineral wells that will be produced.

The construction of the hull and the deck of the vessel 10 takes advantage of the use of flat plate and box girders and allows the shipyard to construct and fully outfit reasonable size hull modules in their work shops.

As can be seen in FIG. 5, a plurality of umbilical I-tubes 46 extend in close proximity to minor columns 32and 36. The umbilical I-tubes 46 are designed to extend control lines from the deck 30 to the ring pontoon 22, and on to the subsea wells 12 and 14. The umbilical I-tubes are fully protected from damage by supply boats and other small craft operating in the proximity of the production unit 10.

Figure 4:
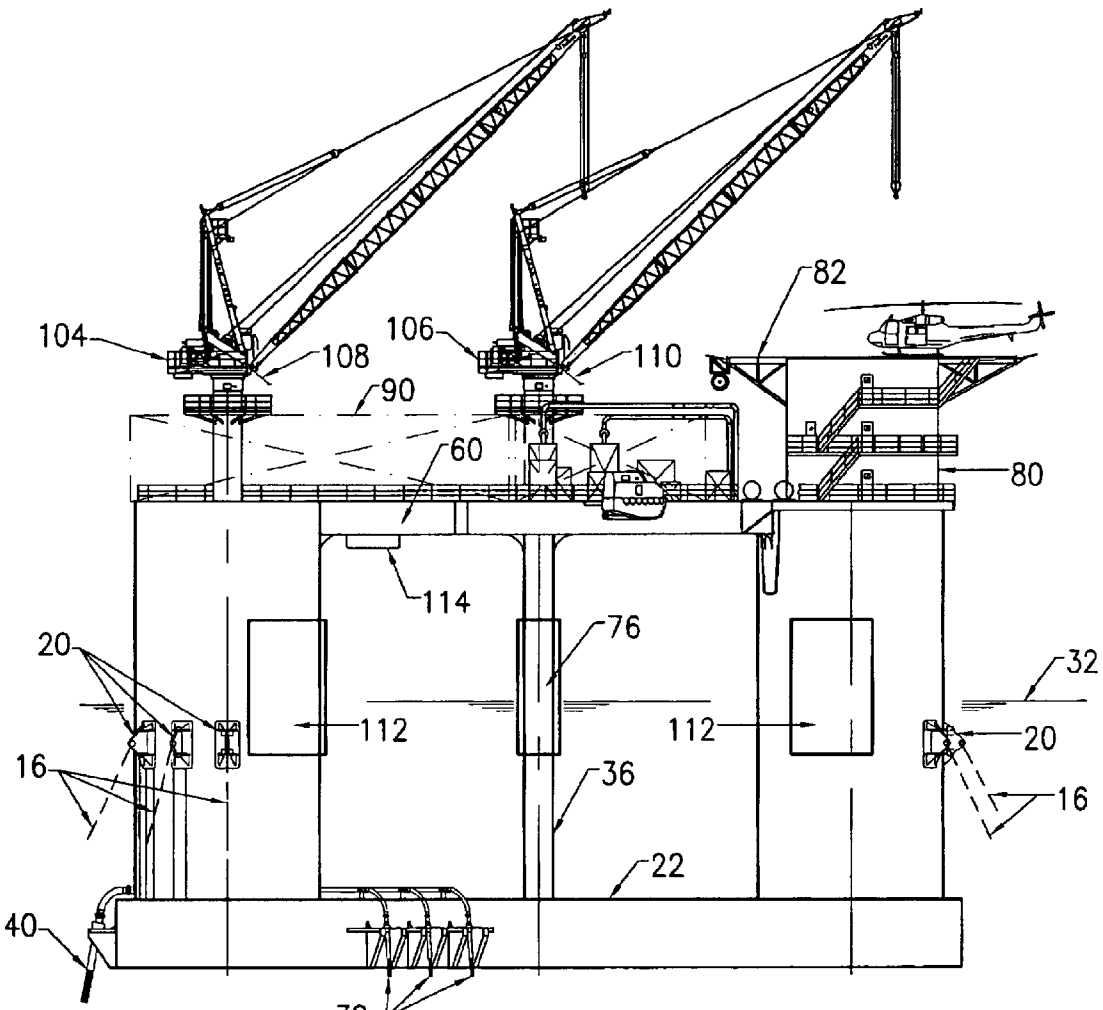
FIG. 4 is a elevation view of the semi-submersible vessel of the present invention.
Figure 6:
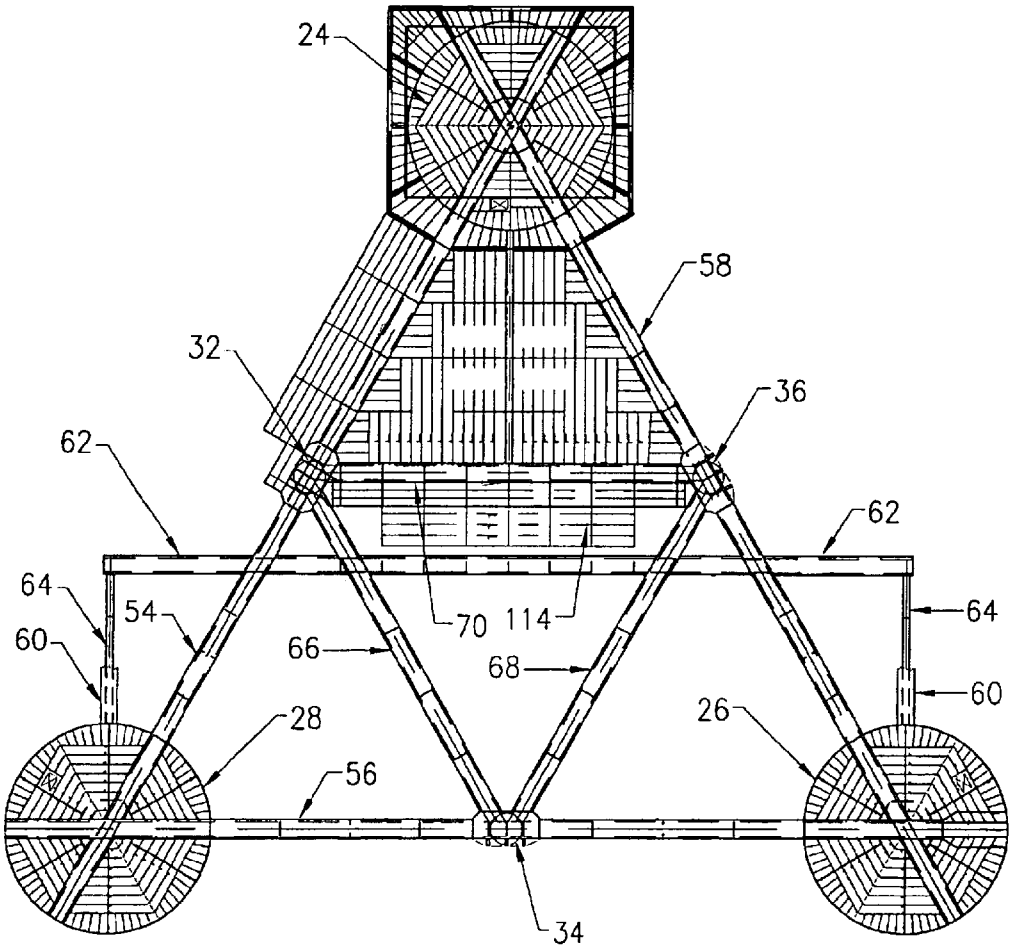
FIG. 6 is a detail view showing the main deck girders.

Turning now to FIG. 6, the connection between the major columns 24, 26, and 28 and minor columns 32, 34, and 36 is shown in more detail. As can be seen in the drawings, the major columns 24, 26, and 28 are connected with connecting members, or deck support box girders 54, 56, and 58 extending though the center of the columns 24, 26, and 28 and forming an equilateral triangle. The connecting members 54, 56, and 58 are constructed of box girders and are located just below the deck structure 30. Additionally; the two aft columns 26 and 28 are connected by brace members 60 and 62, located just below the deck 30, and members 64 that extend from the intersections of members 60 and 62 and slope downward to intertsect the major aft columns 26 and 28 to provide support for the production facilities. The member 64 can be better seen in FIG. 4.

The minor columns 32, 34, and 36 are similarly connected with box girder connecting elements 66, 68 and 70 located below the deck structure 30. The connecting members 66, 68 and 70 form an equilateral triangle. The connecting members 66 and 70 carry the attachment members for the umbilical tubes 46, as can be better seen in FIG. 5. As can be further seen in the drawing, a grating platform 72 is secured between the connecting members 66 and 70. The grating platform also supports a grating walkway 74 which extends between the grating platforms located adjacent to the apex of the triangle defined by the members 66, 68 and 70. As a result, the vessel design of the present invention provides full access to the columns and to the well control umbilicals 46.

The minor columns 32, 34, and 36 are further surrounded by protecting fenders 76 which can be timber or rubber plates designed to protect the minor columns from possible impact of small vessels approaching the semi-submersible structure 10.

Figure 7:
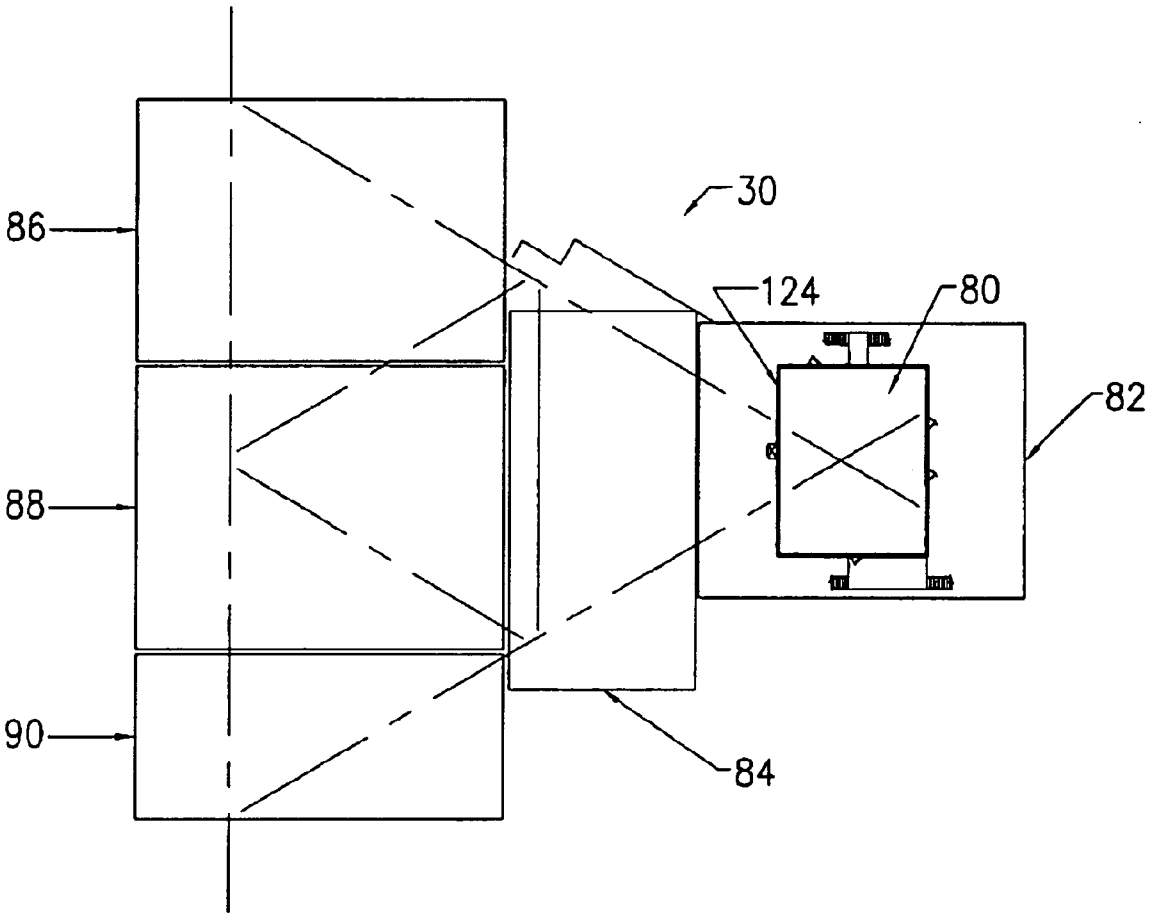
FIG. 7 is a schematic view of the hull main deck showing a plurality of modules that can be incorporated into the platform deck.
Figure 8:
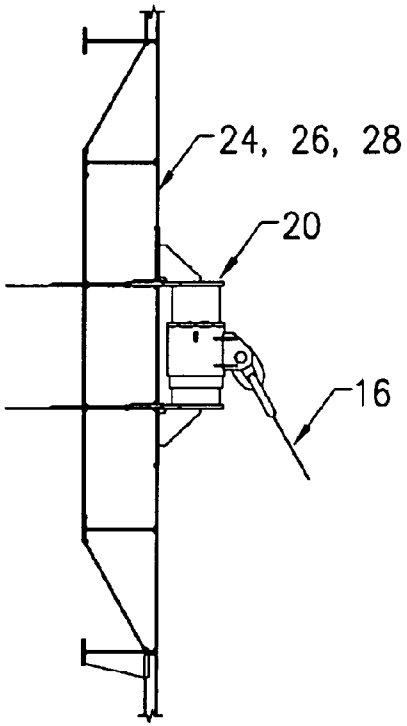
FIG. 8 is a detail view showing attachment of a swivel padeye to the major column shell.

The main deck 30 supports production facilities, electrical generators, and main quarters for the crew. The main deck 30 is shown in a schematic view in FIG. 7, wherein different modules of equipment and facilities can be interchanged to accommodate the specific requirements of the floating vessel 10. The modules can be custom designed for each individual production unit and installed at the shipyard. This arrangement significantly reduces the time required for the construction of the floating production facility 10 and allows the customer to select the modules desired for a particular offshore condition.

The crew living quarters 80 can be positioned below a helicopter deck 82, dual fuel generators 84 can be positioned next to the living quarters 80, and production modules 86, 88, and 90 can be located between the aft columns 26 and 28. The deck 30 is made of open frame members consisting of box girders and flat plate girders for ease of maintenance. The open structure provides support for the production modules without duplicating the deck structure. The modules 80, 84, 86, 88, and 90 can be easily removed and substituted by other modules to change the unit from oil to gas production depending on the field of operation, the number of crew members, etc. More modules can be fabricated well in advance and the vessel 10 may be out of service for a minimum amount of time as it is moved from an oil producing field to a gas producing field.

The pontoon 22 is divided in a plurality of individual ballast compartments 92, which can be individually ballasted inside. There are a total of about 18 ballast compartments utilized to obtain the desired operating draft. Half of the compartments are normally filled and the others are normally empty. Each ballast compartment may be individually emptied for annual inspections and repairs, as necessary, without the need to leave the operating site or shut down the production.

Figure 9:
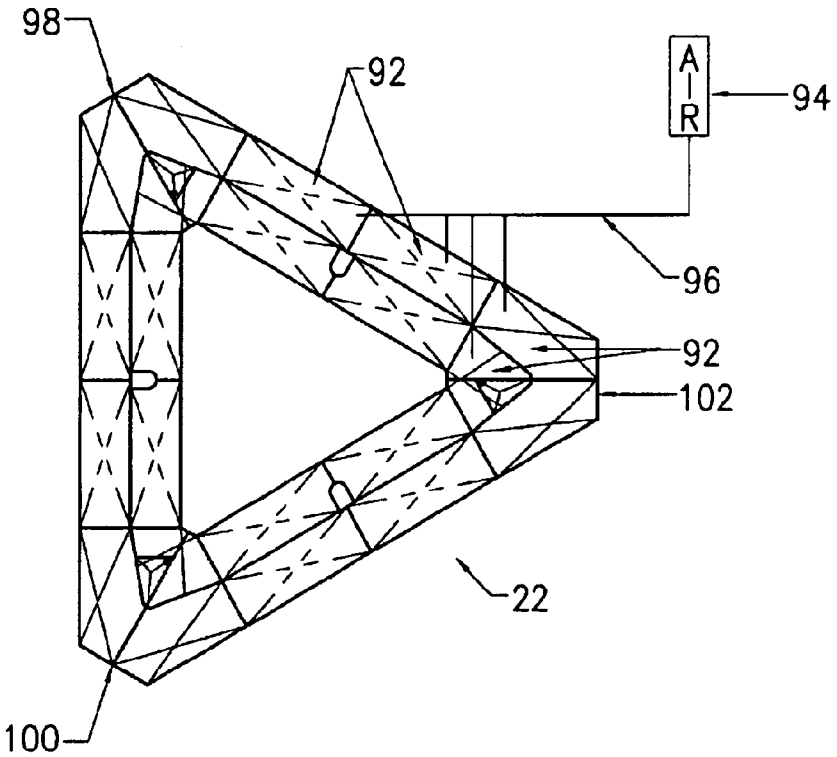
FIG. 9 is a schematic view of the ring pontoon divided into a plurality of ballast compartments.

The vessel 10 utilizes a compressed air ballast system. The ballast tanks are filled with sea water and emptied by injecting low pressure compressed air (less than 40 p.s.i.) from the unit 94 schematically illustrated in FIG. 9. The air forces the water out of a particular compartment, to which the conduit 96 delivering the air is connected. The compressed air ballast system eliminates the necessity of conventional pump rooms, makes the system simpler, and reduces the mandatory staffing requirements that are normally imposed by the U. S. Coast Guard or similar governmental agencies.

The ring pontoon 22 has a generally rectangular cross-section with comers 98, 100 and 102 of the pontoon 22 being defined by straight plates as opposed to rounded, arcuate comers. The flat plates significantly reduce the cost of the construction as rounded corners are conventionally more expensive to manufacture.

The vessel 10 is equipped with two cranes 104 and 106, each of which is provided with an extra winch and pull-in line that can be utilized to facilitate the offshore installation and hook up of the risers and control umbilicals. This arrangement simplifies the offshore functions and greatly reduces the time required for the expensive offshore installation vessels. The extra pull-in line of the starboard crane 104 is schematically designated by numeral 108 in FIG. 4 and the extra pull-in line 110 of the port crane 106 is schematically designated by numeral 110 in FIG. 4.

Each column 24, 26, and 28 is surrounded by fenders 112 that protect the columns from impact from smaller vessels that may be approaching or leaving the vessel 10. The fenders around the major and minor columns also protect the hull from damage by supply boats and other small craft that will approach the production unit 10. This improves safety and minimizes the potential for a catastrophic event during normal operations.

A pair of methanol storage tanks (only one shown in FIG. 6) 114 is secured below the main deck level. The methanol tanks 114 are configured and sized to fit between the girders of the deck 30. Conventionally, the methanol storage tanks are located above the main deck, or the methanol is stored in the pontoon or in the columns of the semi-submersible vessel. By suspending the methanol storage tanks from the main deck 30, the safety of the vessel is considerably improved and the need for compliance with detailed requirements imposed by regulatory agencies and the inspection societies is eliminated.

The dual fuel electrical generators (diesel and natural gas) 84 are installed above the main deck 30; they are provided with weather tight and sound reducing enclosures. Conventionally, the generators are mounted in closed spaces in the pontoon or columns. The instant design minimizes the requirements for insulation and safety systems that would be required if the electrical generators were mounted in an enclosed area. Easy access to the generators also allows replacement of the entire engine and generating unit without the necessity of cutting openings in the deckhouse for maintenance and replacement.

Figure 3:
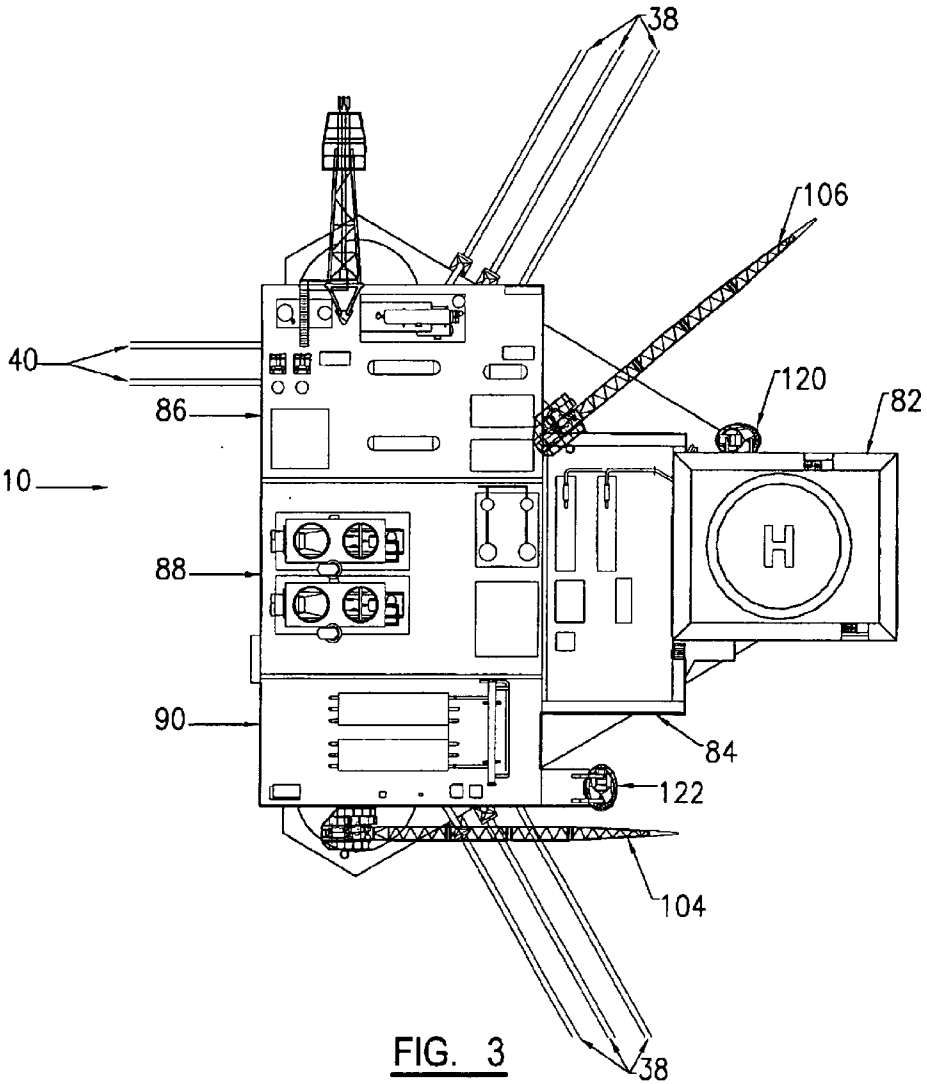
FIG. 3 is a plan view of the vessel in accordance with the present invention.

The vessel 10 is equipped with two 21-men survival capsules 120 and 122 (FIG. 3). The survival capsules 120 and 122 eliminate the mandatory requirement for an independent rescue boat in addition to the survival capsules. This arrangement allows flexibility so that larger quarters could be installed if there is a requirement for more than 12 men to be housed aboard the vessel.

The vessel 10 is provided with a sprinkler system, as well as gas and fire detection systems installed inside the quarters building 80. A wall 124 of the living quarters building 80 that is nearest to the production facilities has an H-60 bulkhead to minimize the potential danger from fire or explosions. The bulkhead 124 protects the personnel and facilities from dangerous conditions that may occur on the vessel 10.

The vessel 10 of the present invention provides benefits and advantages not available heretofore with conventional constructions. The triangularly shaped pontoon has reduced wave loading as compared to conventional semi-submersibles with two separate parallel pontoons. The most significant reductions are the torsional and spread/squeeze wave induced loads. The torsional loading is almost completely eliminated. The spread/squeeze becomes a function of only two columns and a small portion of the pontoons. In traditional semi-submersible designs, all columns and pontoons contribute to the spread/squeeze loading.

The ring pontoon 22 that ties all three major columns together significantly reduces the relative deflection between columns. By rigidly tying the three major columns together, the pontoon becomes capable of reacting to global induced loads. As a result, the upper hull is designed for topside loads only, which in turn allows significant decreases in the weight of the upper hull structure. The vertical center of gravity of the vessel 10 moves lower, directly translating into higher payload capacity of the vessel 10.

The square corners (between the sides and top and bottom of the rectangular crosssection of the pontoon 22) add a significant amount of viscous dampening to all six degrees of freedom. As a result, the vessel motions are "softer" and the natural period of reaction to the wave motion may be increased. In addition, the large horizontal area of the ring pontoon in combination with the relatively shallow distance from the keel to the deck improves the vessel's heave characteristics and shifts the natural frequency for the heave reactions.

The combined effect of these features provides the greatest efficiency with respect to steel weight versus the allowable deck loads, dampens the heave motions, reduces the roll motions, reduces the stresses in the primary structural members and improves the fatigue life. Although the pitch motions may be slightly higher compared to a rectangular-shaped semi-submersible vessel, the pitch motions are not a limiting factor for operation of the production unit.

The open frame main deck construction reduces the weight of the deck and facilitates modular construction. The simplified ballast system reduces the costs, and eliminates the need for a pump room. The three minor columns strategically placed between the three major columns reduce the deck beam span and the weight of the steel required for supporting the deck loads. The vessel 10 can be fully outfitted at the shipyard with reduced capital expenditures and improved overall project schedule.

There are no complicated complex connections between the pontoons, or the major columns. There is no need for thrusters, engines and other similar equipment for dynamic positioning of the vessel 10. It is envisioned that under certain circumstances, the vessel of the present invention can be used for production depths up to 10,000 feet. The modular construction allows retrofit of the vessel for different well conditions. The elimination of conventional winches onboard frees the valuable deck space for more important equipment and production facilities and reduces weight by eliminating the mooring equipment and chain lockers. Optimum semi-taut mooring configuration is pre-set beforehand, leaving smaller excursions of the vessel, even if one mooring line is broken.

When retrofitting the vessel from oil to gas production requirements, it will not be necessary to dry-dock the vessel and effect the modifications before moving the vessel to another site. If necessary, additional production modules can be added to the deck to handle the produced fluids more effectively when the unit is moved to another field. As a result, the owner of the vessel can amortize the primary capital expenditures over several fields, which significantly influences the overall economics of the vessel operation.

Each of the above-the-deck modules has its own deck and can be mounted directly onto the hull box girders 54, 56, and 58. The vessel 10 has a nearly constant draft (54 to 55 feet) for both the operating and survival conditions without the need to change the amount of ballast water. This arrangement minimizes the need for complex piping systems and large pumps, without the need for "oil-over-water" storage that can create potential environmental hazards.

The pontoon and the columns are accessible from the deck for maintenance and repairs, as required. The minor columns as well as the major columns allow access into the ballast compartments, providing means of access into any ballast tank in the pontoon. The three major columns and the three minor columns allow access to the pontoon so that when inspection of a particular ballast tank is required, the water can be transferred from that compartment into a normally empty compartment to allow the inspection to proceed. Usually, the outer peripheral ballast tanks are filled and the inboard tanks remain empty. Shifting the ballast medium from one tank to another can be easily accomplished with the use of the compressed air ballast system.

The flexible positioning of the risers allows a change in the angle of the riser connection to the vessel from a 4- to a 7-degree angle in relation to vertical and allows total flexibility to handle any of the ranges and sizes of the risers.

Many changes and modifications can be made in the design of the present invention without departing from the spirit thereof. We therefore pray that our rights to the present invention be limited only by the scope of the appended claims.

We claim:

1. A semi-submersible vessel, comprising: a ring pontoon comprised of pontoon members rigidly connected together, said pontoon members forming an equilateral triangle;

a plurality of main columns extending upwardly from locations adjacent to corners of the ring pontoon, while the pontoon members extend outboard of the main columns;

a plurality of secondary columns, each secondary column having a water plane significantly smaller than the water plane of any of the main columns, said secondary columns extending upwardly from the pontoon members; and a deck supported by upper portions of said main columns and said secondary columns.

2. The vessel of claim 1, wherein comers of said equilateral triangle are defined by straight plates.

3. A semi-submersible vessel, comprising:

a ring pontoon comprised of pontoon members rigidly connected together, a plurality of main columns extending upwardly from locations adjacent to corners of the ring pontoon while the pontoon members extend outboard of the main columns;

a plurality of secondary columns, each secondary column having a water plane significantly smaller than the water plane of any of the main columns, said secondary columns extending upwardly from the pontoon members and being rigidly connected together by secondary connecting members, said secondary connecting members forming an equilateral triangle; and a deck supported by upper portions of said main columns and said secondary columns.

4. A semi-submersible vessel, comprising:

a ring pontoon comprised of pontoon members rigidly connected together by connecting members and forming an equilateral triangle;

a plurality of main columns extending upwardly from comers of the ring pontoon;

a plurality of secondary columns, each secondary column having a water plane significantly smaller than the water plane of any of the main columns, said secondary columns extending upwardly from the pontoon members;

a deck supported by upper portions of said main columns and said secondary columns; and a plurality of production and export risers for transporting produced mineral resources to a facility outside of said vessel, said risers being connected to said vessel below a water line.

5. The vessel of claim 4, wherein said vessel is adapted for semi-permanent mooring with pre-tensioned mooring lines, and wherein a vertical component of a load from the mooring lines is transferred to the main columns below the water line.

6. The vessel of claim 5, wherein upper ends of said mooring lines are secured to swivel padeyes attached to the main columns below the water line.

7. The vessel of claim 4, wherein said connecting members form an equilateral triangle.

8. The vessel of claim 7, wherein corners of said equilateral triangle are defined by straight plates.

9. The vessel of claim 4, wherein said secondary columns are rigidly connected together by secondary connecting members.

10. The vessel of claim 9, wherein said secondary connecting members form an equilateral triangle.

11. The vessel of claim 4, wherein said ring pontoon is divided into a plurality of separate ballast compartments.

12. The vessel of claim 11, wherein said vessel further comprises a compressed air ballast system for selectively evacuating ballast medium from said ballast compartments.

13. The vessel of claim 4, further comprising special liquid storage tanks suspended below the deck.

14. The vessel of claim 4, wherein electrical power generators are positioned on the deck of the vessel.

15. The vessel of claim 4, wherein each of said main columns and said secondary columns is provided with fenders for protecting said main columns and said secondary columns from impact with floating bodies.

16. A semi-submersible vessel, comprising:

a ring pontoon comprised of pontoon members rigidly connected together;

a plurality of main columns extending upwardly from locations adjacent to corners of the ring pontoon, while the pontoon members extend outboard of the main columns;

a plurality of secondary columns rigidly connected together by secondary connecting members that form an equilateral triangle, each secondary column having a water plane significantly smaller than the water plane of any of the main columns, said secondary columns extending upwardly from the pontoon members from locations midway between the main columns, and a deck supported by upper portions of said main columns and said secondary columns.

* * * * *